US011250797B2

(12) United States Patent
Lee

(10) Patent No.: US 11,250,797 B2
(45) Date of Patent: Feb. 15, 2022

(54) METHOD FOR DRIVING DISPLAY PANEL AND DISPLAY PANEL

(71) Applicant: HKC CORPORATION LIMITED, Shenzhen (CN)

(72) Inventor: Chia-Hang Lee, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 16/982,045

(22) PCT Filed: Mar. 11, 2019

(86) PCT No.: PCT/CN2019/077605
§ 371 (c)(1),
(2) Date: Sep. 18, 2020

(87) PCT Pub. No.: WO2020/118927
PCT Pub. Date: Jun. 18, 2020

(65) Prior Publication Data

US 2021/0104200 A1 Apr. 8, 2021

(30) Foreign Application Priority Data

Dec. 11, 2018 (CN) ..... 201811510622.3

(51) Int. Cl.
*G09G 3/36* (2006.01)

(52) U.S. Cl.
CPC ... *G09G 3/3607* (2013.01); *G09G 2320/0666* (2013.01); *G09G 2320/0673* (2013.01); *G09G 2360/16* (2013.01)

(58) Field of Classification Search
CPC ..... G09G 3/3607; G09G 2320/0666; G09G 2320/0673; G09G 2360/16
See application file for complete search history.

(56) References Cited

U.S. PATENT DOCUMENTS 5,172,227 A 12/1992 Tsai et al.
10,078,998 B2 * 9/2018 Chu ..... G09G 5/10
2010/0238101 A1 9/2010 Jhuo et al.

FOREIGN PATENT DOCUMENTS

CN 1770258 A 5/2006
CN 1856117 A 11/2006
(Continued)

OTHER PUBLICATIONS

Jianjun Xie, the International Searching Authority written comments, dated Sep. 2019, CN.
(Continued)

*Primary Examiner* — Kenneth B Lee, Jr.

(57) ABSTRACT

This application discloses a method for driving a display panel and a display panel, the driving method including steps of: inputting a frame of image; obtaining a signal of the frame of image progressively scanned by the display panel; selecting each row of pixels in the frame of image by using a multiple of 2 as an interval, and calculating a color saturation level of each of the selected pixels at intervals to form a color saturation value; determining a chromatic aberration level of the frame of image according to the color saturation value; adjusting a gamma curve value according to the chromatic aberration level of the frame of image; and driving the display panel by using the adjusted gamma curve value.

12 Claims, 5 Drawing Sheets

(56) References Cited

FOREIGN PATENT DOCUMENTS

| | | | |
|---|---|---|---|
| CN | 1989772 | | 6/2007 |
| CN | 105069756 | A | 11/2015 |
| CN | 108053796 | | 5/2018 |
| JP | H06324657 | | 11/1994 |

OTHER PUBLICATIONS

Jianjun Xie, the International Search Report, dated Sep. 2019, CN.

* cited by examiner

METHOD FOR DRIVING DISPLAY PANEL AND DISPLAY PANEL

CROSS REFERENCE OF RELATED APPLICATIONS

This application claims priority to Chinese Patent Application No. CN201811510622.3, filed with the National Intellectual Property Administration, PRC on Dec. 11, 2018 and entitled "METHOD FOR DRIVING DISPLAY PANEL AND DISPLAY PANEL", which is incorporated herein by reference in its entirety.

TECHNICAL FIELD

This application relates to the field of display apparatuses, and in particular, to a method for driving a display panel and a display panel.

BACKGROUND

Statement herein merely provides background information related to this application and does not necessarily constitute the existing technology.

With development and advancement of science and technologies, due to hot spots such as thinness, power saving, and low radiation, liquid crystal displays become mainstream products of displays and are widely applied. Most liquid crystal displays in the current market are backlit liquid crystal displays, including a liquid crystal panel and a Backlight Module (BM). The working principle of the liquid crystal panel is: Liquid crystal molecules are placed between two parallel opposing glass substrates, and a drive voltage is applied across the two glass substrates to control rotating directions of the liquid crystal molecules, so that light in the backlight module is refracted out to generate an image.

A Thin Film Transistor-Liquid Crystal Display (TFT-LCD) has performance such as low power consumption, good picture quality, and a relatively high production yield and therefore has currently gradually been dominant in the field of display. Similarly, the TFT-LCD includes a liquid crystal panel and a backlight module, the liquid crystal panel includes a Color Film substrate (CF Substrate, also referred to as a color filter substrate), a Thin Film Transistor substrate (TFT Substrate), and a mask (Mask). A transparent electrode exists at opposite inner sides of the substrates described above. A layer of Liquid Crystal (LC) molecules is sandwiched between the two substrates.

A gamma curve is an important photoelectric conversion curve for a television. Generally, a gamma curve value of the television is designed to be 2.2 to effectively compensate an existing display system, so that human eyes can obtain a best display effect. However, because of anisotropy of the LCD display, a gamma curve of the LCD from a positive viewing angle is different from a gamma curve of the LCD from a side viewing angle. Especially, fora Vertica Alignment (VA) panel, an offset of a gamma curve of the VA panel from a side viewing angle is too large, resulting in obviously poor picture quality performance of some images. Therefore, a color cast alleviating technology for improving an LCD panel is important to an LCD display. Such a viewing angle characteristic is expected to be improved in various critical technologies.

SUMMARY

This application provides a method for driving a display panel and a display panel to improve a visual chromatic aberration characteristic of an LCD display.

To achieve the foregoing objective, this application provides a method for driving a display panel, the driving method including steps of:

inputting a frame of image;

determining a chromatic aberration level of the frame of image;

adjusting a gamma curve value according to the chromatic aberration level of the frame of image; and driving the display panel by using the adjusted gamma curve value.

Optionally, the step of adjusting a gamma curve value according to chromatic aberration level of the frame of image includes:

decreasing the gamma curve value if the chromatic aberration level of the frame of image is greater than or equal to a preset threshold.

Optionally, the step of adjusting a gamma curve value according to the chromatic aberration level of the frame of image includes:

maintaining an original gamma curve value if the chromatic aberration level the frame of image is less than the preset threshold.

Optionally, the step of determining a chromatic aberration level of the frame of image includes:

obtaining a signal of the frame of image progressively scanned by the display panel;

calculating a color saturation level of each pixel iiu the frame of image to form a color saturation value;

collecting and accumulating the color saturation values of each row of pixels respectively to form line buffer data and storing the line buffer data in a line buffer;

accumulating the line buffer data of all rows progressively to form frame buffer data;

comparing all the color saturation values in the frame buffer data to obtain by calculation a maximum color saturation value to represent a color saturation level of the frame of image; and determining the chromatic aberration level of each frame of image by using the maximum saturation value of each frame of image, where a larger color saturation value indicates a higher chromatic aberration level.

Optionally, the step of calculating a color saturation level of each pixel in the frame of image to form a color saturation value includes:

selecting each row of pixels in the frame of image by using a multiple of 2 as an interval, and calculating a color saturation level of each of the selected pixels at intervals to form a color saturation value, where a formula of calculating the color saturation value is:

a formula $S=\max(R,G,B)-\min(R,G,B)$, where $S$ represents the color saturation value, $R$ represents a gray level of a red sub-pixel, $G$ represents a gray level of a green sub-pixel, and $B$ represents a gray level of a blue sub-pixel.

Optionally, a data size of each color saturation value is less than or equal to 6 bits.

Optionally, each row of pixels in the frame of image are selected by using 32 as an interval, and a color saturation level of each of the selected pixels is calculated at intervals to form a color saturation value.

Optionally, the step of adjusting a gamma curve value according to the chromatic aberration level of the frame of image includes:

finding the adjusted gamma curve value from a gamma adjustment lookup table according to the color saturation value of the frame of image and controlling and adjusting the gamma curve value.

Optionally, the gamma adjustment lookup table is formed in advance by setting a corresponding gamma adjustment value for each of different color saturations; and when the color saturation value is 60, a difference between the adjusted gamma curve value and the original gamma curve value is the largest, and when the color saturation value is not equal to 60, a color saturation value farther away from 60 indicates a smaller difference between the gamma curve value and the original gamma curve value.

When the color saturation value is between 0 and 120, the gamma adjustment value satisfies that gamma is equal to 2.2.

This application further provides a method for driving a display panel, the method including steps of:

inputting a frame of image;

obtaining a signal of the frame of image progressively scanned by the display panel;

selecting each row of pixels in the frame of image by using a multiple of 2 as an interval, and calculating; a color saturation level of each of the selected pixels at intervals to form a color saturation value, where a formula of calculating the color saturation value is:

a formula $S=\max(R,G,B)-\min(R,G,B)$, where $S$ represents the color saturation value;

collecting and accumulating the color saturation values of each row of pixels respectively to form line buffer data and storing the line buffer data in a line buffer;

accumulating the line buffer data of all rows progressively to form frame buffer data, where a data size of each color saturation value is less than or equal to 6 bits;

comparing all the color saturation values in the frame buffer data to obtain by calculation a maximum color saturation value to represent the color saturation level of the frame of image;

determining the chromatic aberration level of each frame of image by using the maximum saturation value of each frame of image, where a larger color saturation value indicates a higher chromatic aberration level.

The gamma curve value is decreased if the chromatic aberration level of the frame of image is greater than or equal to a preset threshold;

An original gamma curve value is maintained if the chromatic aberration level of the frame of image is less than the preset threshold.

The display panel is driven by using the adjusted gamma curve value.

Another objective of this application is to disclose a display panel, using the method for driving a display panel described above.

A gamma curve value is an important parameter for driving a display panel. The gamma curve value plays a decisive role in a display effect of a picture. A gamma curve is an important photoelectric conversion curve for a television. Generally, a gamma curve value of the television is designed to be 2.2 to effectively compensate an existing display system, so that human eyes can obtain a best display effect. However, because of anisotropy of the LCD display, a gamma curve of the LCD from a positive viewing angle is different from a gamma curve of the LCD from a side viewing angle. Especially, for a VA panel, an offset of a gamma curve of the VA panel from a side viewing angle is too large (as shown in FIG. 1), resulting in obviously poor picture quality performance of some images. Moreover, it is found by the inventor that generally, a smaller gamma curve value indicates a smaller viewing angle chromatic aberration; and a larger the gamma curve value indicates a larger viewing angle chromatic aberration. Therefore, an image analysis processing method is designed to adjust a gamma curve value according to a content characteristic of a picture. First, a frame of image is input to determine a chromatic aberration level of the frame of image, then, a gamma curve value is adjusted according to the chromatic aberration level of the frame of image; and the display panel is driven by using the adjusted gamma curve value. In this way, when the chromatic aberration is large, the gamma curve value is decreased correspondingly to decrease the chromatic aberration, thereby optimizing a display effect of a picture.

BRIEF DESCRIPTION OF DRAWINGS

The included accompanying drawings are used to provide further understanding of the embodiments of this application, constitute a part of the specification, and are used to illustrate implementations of this application and explain the principle of this application together with literal descriptions. Apparently, the accompanying drawings in the following descriptions are merely some embodiments of this application, and a person of ordinary skill in the art can also obtain other accompanying drawings according to these accompanying drawings without involving any creative effort. In the accompanying drawings.

DETAILED DESCRIPTION OF EMBODIMENTS

Figure 1:
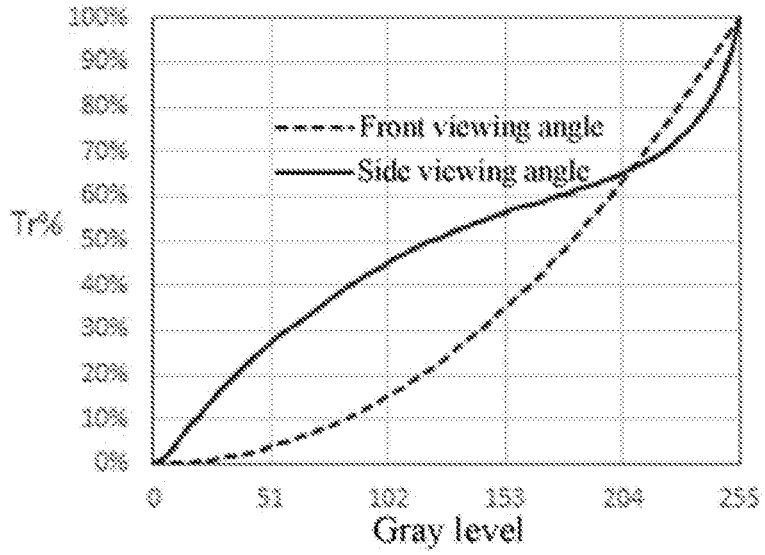
FIG. 1 is a schematic diagram of a viewing angle and a gamma curve value according to an embodiment of this application.

Specific structures and functional details disclosed herein are merely representative, and are intended to describe the objectives of the exemplary embodiments of this application. However, this application may be specifically implemented in many alternative forms, and should not be construed as being limited to the embodiments set forth herein.

In the description of this application, it should be understood that orientation or position relationships indicated by the terms such as "center", "transverse", "on", "below", "left", "right", "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation.

Therefore, such terms should not be construed as limiting of this application. In addition, the terms such as "first" and "second" are used only for the purpose of description, and should not be understood as indicating or implying the relative importance or implicitly specifying the number of the indicated technical features. Therefore, a feature defined by "first" or "second" can explicitly or implicitly includes one or more of said features. In the description of this application, unless otherwise stated, "a plurality of" means two or more than two. In addition, the terms "comprise", "include" and any variant thereof are intended to cover non-exclusive inclusion.

In the description of this application, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. A person of ordinary skill in the art may understand the specific meanings of the foregoing terms in this application according to specific situations.

The terminology used herein is for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "comprise" and/or "include" when used in this specification, specify the presence of stated features, integers, steps, operations, elements, and/or components, but do not preclude the presence or addition of one or more other features, integers, steps, operations, elements, components, and/or combinations thereof.

In figures, units with similar structures are represented by using a same reference number.

Figure 2:
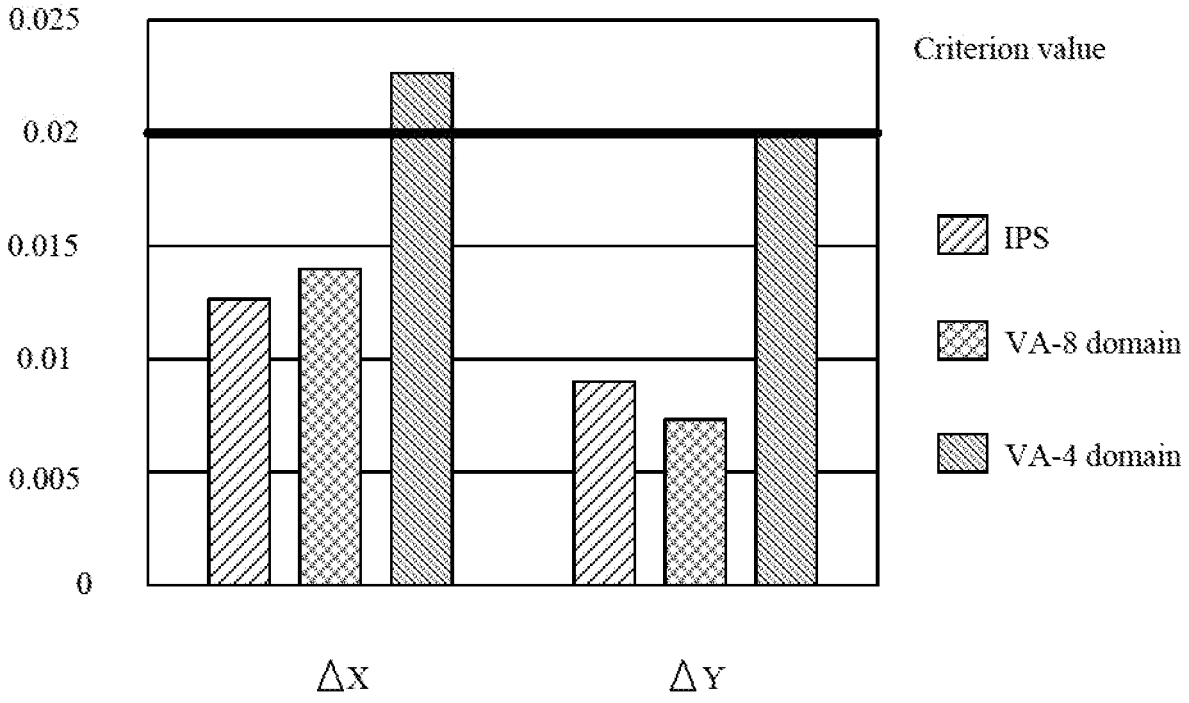
FIG. 2 is, a schematic diagram of a skin tone chromatic aberration according to an embodiment of this application.
Figure 3:
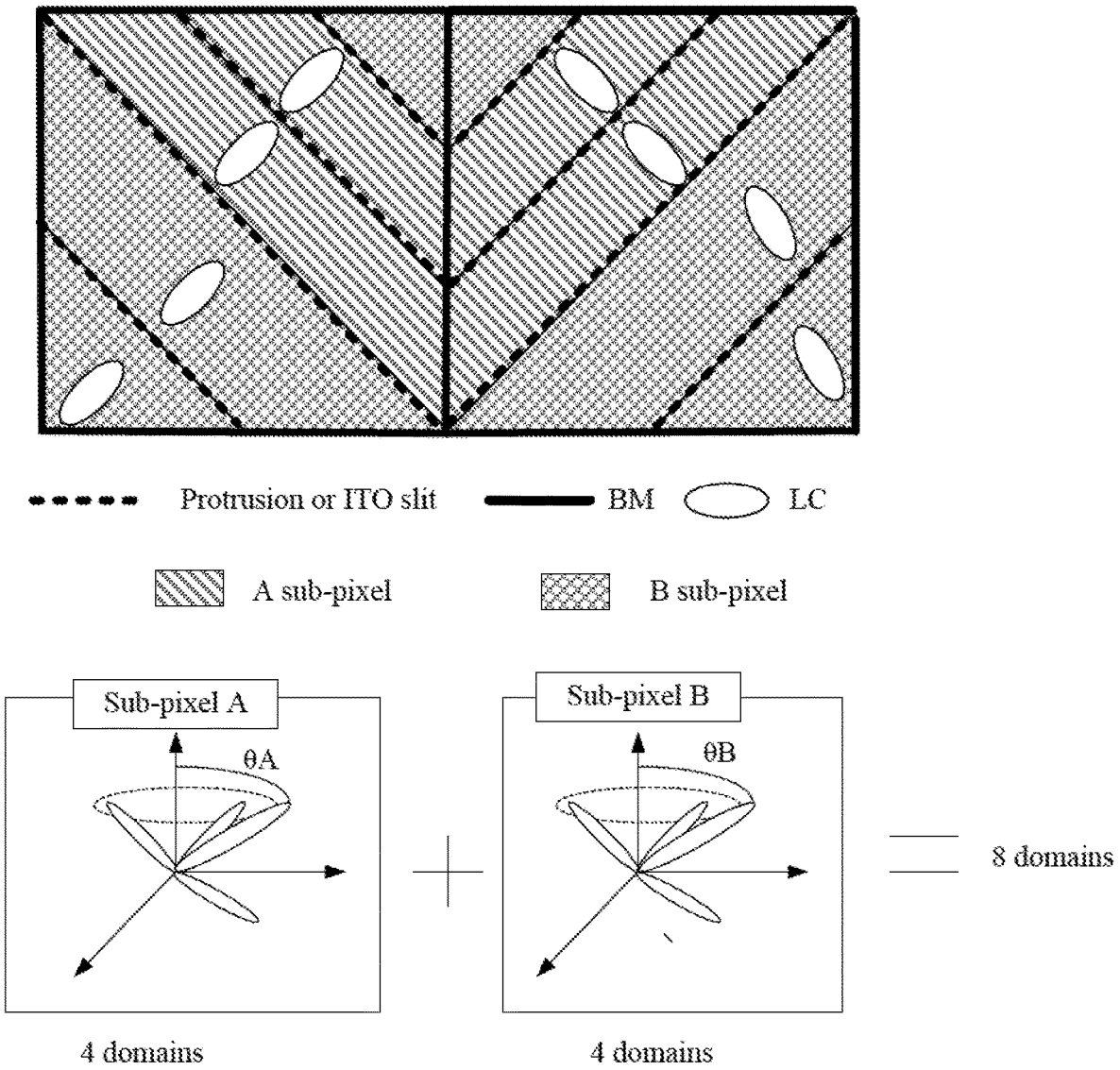
FIG. 3 is a schematic diagram of a multi-regional pixel design according to an embodiment of this application.
Figure 4:
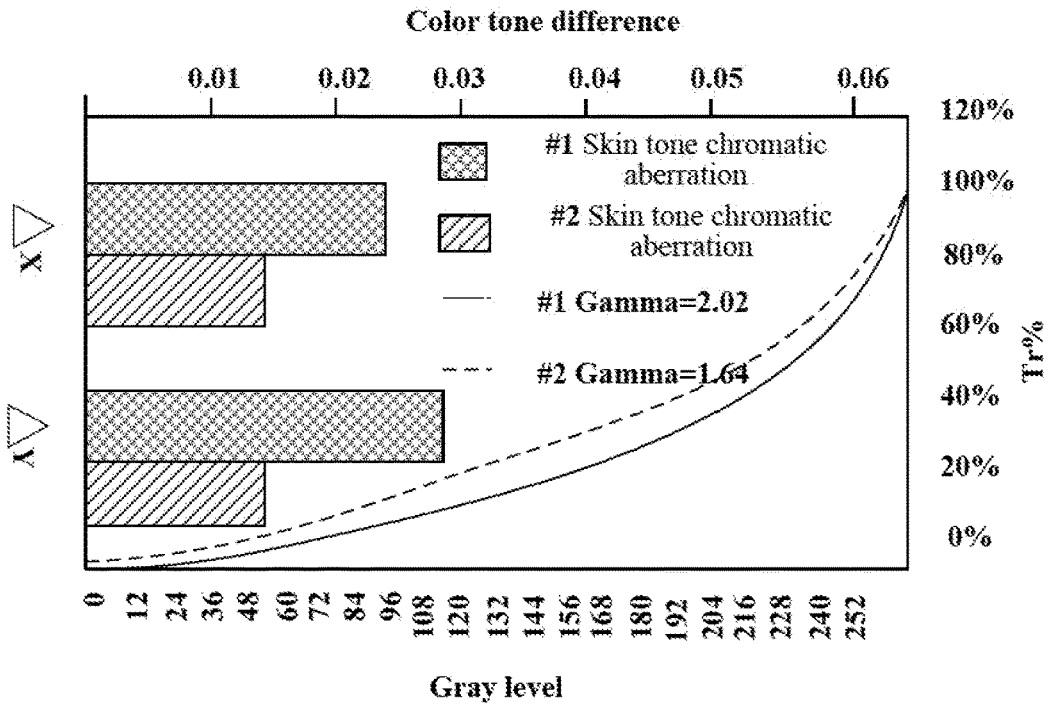
FIG. 4 is a schematic diagram of a gamma curve value and a visual chromatic aberration according to an embodiment of this application.
Figure 5:
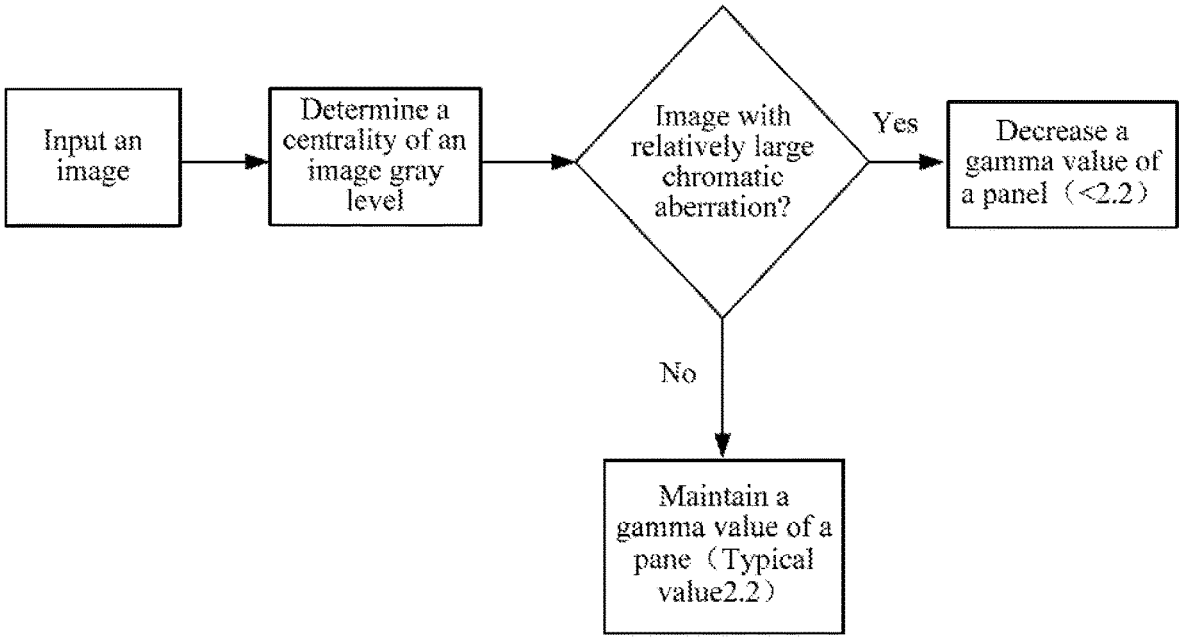
FIG. 5 is a schematic diagram of a process of a dynamic gamma curve algorithm according to an embodiment of this application.

An undisclosed technical solution is as follows:

As shown in FIG. 1 to FIG. 3, a viewing angle improving manner for an LCD is designing a pixel design with 8 domains, so that liquid crystals are symmetrically designed in pixel space, to compensate for an optical phase difference caused by different viewing angles, as shown in FIG. 3. However, using a multi-regional pixel designing manner not only increases difficulty of pixel designing, wires of pixels, included electrodes, TFT components, and the like, but also decreases an aperture ratio of each pixel. Therefore, a method for improving picture quality of a viewing angle through an image processing method is very important.

This application is further described below with reference to the accompanying drawings and embodiments.

As shown in FIG. 1 to FIG. 7, the embodiments of this application disclose a method for driving a display panel, the driving method includes the following steps:

Step 81: inputting a frame of image;

Step 82: determining a chromatic aberration level of the frame of image;

Step 83: adjusting a gamma curve value according to the chromatic aberration level of the frame of image; and Step 84: driving the display panel by using the adjusted gamma curve value.

A gamma curve value is an important parameter for driving a display panel. The gamma curve value plays a decisive role in a display effect of a picture. A gamma curve is an important photoelectric conversion curve for a television. Generally, a gamma curve value of the television is designed to be 2.2 to effectively compensate an existing display system, so that human eyes can obtain a best display effect. However, because of anisotropy of the LCD display, a gamma curve of the LCD from a positive viewing angle is different from a gamma curve of the LCD from a side viewing angle. Especially, for a VA panel, an offset of a gamma curve of the VA panel from a side viewing angle is too large (as shown in FIG. 1), resulting in obviously poor picture quality performance of some images. Moreover, it is found by the inventor that generally, a smaller gamma curve value indicates a smaller viewing angle chromatic aberration; and a larger the gamma curve value indicates a larger viewing angle chromatic aberration. Therefore, an image analysis processing method is designed to adjust a gamma curve value according to a content characteristic of a picture. First, a frame of image is input to determine a chromatic aberration level of the frame of image, then, a gamma curve value is adjusted according to the chromatic aberration level of the frame of image, and the display panel is driven by using the adjusted gamma curve value. In this way, when the chromatic aberration is large, the gamma curve value is decreased correspondingly to decrease the chromatic aberration, thereby optimizing a display effect of a picture.

In one or more embodiments, the step of adjusting a gamma curve value according to the chromatic aberration level of the frame of image includes:

decreasing the gamma curve value if the chromatic aberration level of the frame of image is greater than or equal to a preset threshold.

The gamma curve value is adjusted mainly by referring to the preset threshold. If the chromatic aberration level of the frame of image is greater than or equal to the preset threshold, an impact of the chromatic aberration is relatively large, and the gamma curve value needs to be decreased. (For example, when the value of the chromatic aberration level is equal to 0, that is, there is no chromatic aberration, or when the chromatic aberration level is less than 0.02 at a viewing angle of 30 degrees, the gamma curve value does not need be adjusted. When the above range is exceeded, an offset of the chromatic aberration is larger, and correspondingly, a value by which the gamma curve value is decreased is larger to decrease the chromatic aberration, thereby improving a display effect of a picture).

In one or more embodiments, the step of adjusting a gamma curve value according to the chromatic aberration level of the frame of image includes:

maintaining an original gamma curve value if the chromatic aberration level the frame of image is less than the preset threshold.

Effect analysis: The gamma curve value needs to be adjusted by referring to the preset threshold. If the chromatic aberration level of the frame of image is less than the preset threshold, an impact of the chromatic aberration is not large, and it only needs to maintain the original gamma curve value. In this way, a workload of adjusting the gamma curve value may be decreased, so that useless work may be avoided while decreasing the chromatic aberration (for example, when the chromatic aberration level is less than 0.02 at a viewing angle of 30 degrees).

In one or more embodiments, the step of determining a chromatic aberration level of the frame of image includes:

obtaining a signal of the frame of image progressively scanned by the display panel;

calculating a color saturation level of each pixel in the frame of image to form a color saturation value;

collecting and accumulating the color saturation values of each row of pixels respectively to form line buffer data and storing the line buffer data in a line buffer;

accumulating the role buffer data of all rows progressively to form frame buffer data;

comparing all the color saturation values in the frame buffer data to obtain by calculation a maximum color saturation value to represent a color saturation level of the frame of image; and determining the chromatic aberration level of each frame of image by using the maximum saturation value of each frame of image, where a larger color saturation value indicates a higher chromatic aberration level.

Determining the chromatic aberration level of the frame of image is an important step of this method. A basis for the determining should be sufficient, and the obtained data should be accurate. First, a signal of the frame of image progressively scanned by the display panel is obtained. Then, a color saturation level of each pixel in the frame of image is calculated to form a color saturation value. The color saturation values of each row of pixels are collected and accumulated respectively to form line buffer data, and the line buffer data is stored in a line buffer, and then, the line buffer data of all rows is accumulated progressively to form frame buffer data. All the color saturation values in the frame buffer data are compared to obtain by calculation a maximum color saturation value to represent a color saturation level of the frame of image. Generally, a larger color saturation value indicates a corresponding higher chromatic aberration. In this way, a color saturation level that is visible and that can be processed, that is, a maximum saturation value of each frame of image, is adapted to represent a frame of image for determining a chromatic aberration level, to determine whether a gamma value needs to be adjusted, so that determining of a chromatic aberration level by human eyes is converted to data, thereby detecting a chromatic aberration. Therefore, different gamma curve values can be provided according to different chromatic aberration levels, thereby decreasing color casts.

In one or more embodiments, the step of calculating a color saturation level of each pixel in the frame of image to form a color saturation value includes:

selecting each row of pixels in the frame of image by using a multiple of 2 as an interval, and calculating a color saturation level of each of the selected pixels at intervals to form a color saturation value, where a formula of calculating the color saturation value is:

> a formula $S=\max(R,G,B)-\min(R,G,B)$, where $S$ represents the color saturation value, $R$ represents a hue of a red sub-pixel, $G$ represents a hue of a green sub-pixel, and $B$ represents a hue of a blue sub-pixel.

When the color saturation level is calculated, the formula $S=\max(R,G,B)-\min(R,G,B)$ is mainly employed. The color saturation level is selected according to a difference between a maximum value and a minimum value. A color saturation is closely related to a color tone of a pixel, and the color tone and the color saturation are both closely related to a chromatic aberration. A color saturation value of a whole frame can be calculated to represent a chromatic aberration condition of a whole frame of image to a specific extent. Therefore, a chromatic aberration is replaced with a color saturation that can be digitalized, so that a processor can find, according to different color saturations, a desired gamma curve value from a gamma adjustment lookup table for driving, thereby decreasing the chromatic aberration.

In one, or more embodiments, each row of pixels in the frame of image are selected by using 32 as an interval, and a color saturation level of each of the selected pixels is calculated at intervals to form a color saturation value.

To decrease an amount of storage, each row of pixels in the frame of image are selected by using 32 as an interval, and a color saturation level of each of the selected pixels is calculated at intervals to form a color saturation value, which is most cost-efficient.

In one or more embodiments, the step of adjusting a gamma curve value according to the chromatic aberration level of the frame of image includes:

finding the adjusted gamma curve value from a gamma adjustment lookup table according to the color saturation value of the frame of image and controlling and adjusting the gamma curve value.

A correspondence can be quickly determined by setting a lookup table, to quickly respond to adjustment of a gamma curve value. The adjusted gamma curve value is found from a gamma adjustment lookup table according to the color saturation value of the frame of image and the gamma curve value is controlled and adjusted.

In one or more embodiments, the gamma adjustment lookup table is formed in advance by setting a corresponding gamma adjustment value for each of different color saturations.

When the color saturation value is 60, a difference between the adjusted gamma curve value and the original gamma curve value is the largest, and when the color saturation value is not equal to 60, a color saturation value farther away from 60 indicates a smaller difference between the gamma curve value and the original gamma curve value.

Figure 7:
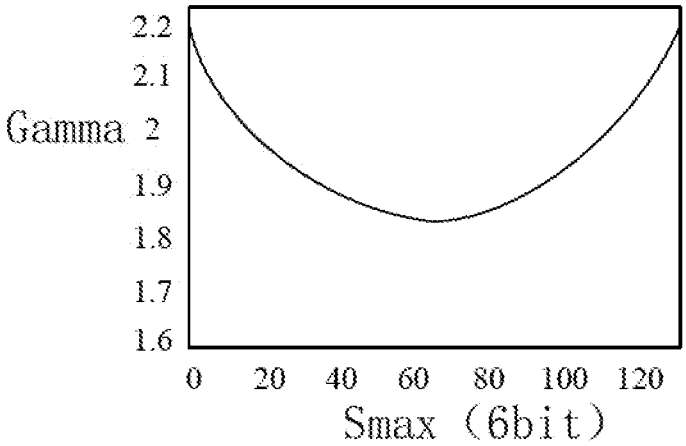
FIG. 7 is a schematic diagram of a correspondence between a gamma value and an S max value according to an embodiment of this application.

When the color saturation value is between 0 and 120, the gamma adjustment value satisfies that a gamma value is equal to 2.2 (for example, as shown in FIG. 7, when S=60, the gamma curve value is set to approximately 1.85).

In one or more embodiments, referring to FIG. 1 to FIG. 7, discloses a method for driving a display panel, the method including steps of:

inputting a fiance of image;

obtaining a signal of the frame of image progressively scanned by the display panel;

selecting each row of pixels in the flame of image by using a multiple of 2 as an interval, and calculating a color saturation level of each of the selected pixels at intervals to form a color saturation value, where a formula of calculating the color saturation value is:

> a formula $S=\max(R,G,B)-\min(R,G,B)$, where $S$ represents the color saturation value; collecting and accumulating the color saturation values of each row of pixels respectively to form line buffer data and storing the line buffer data in a line buffer;

accumulating the line buffer data of all rows progressively to form frame buffer data, where a data size of each color saturation value is less than or equal to 6 bits;

comparing all the color saturation values in the frame buffer data to obtain by calculation a maximum color saturation value to represent the color saturation level of the frame of image;

determining the chromatic aberration level of each frame of image by using the maximum saturation value of each frame of image, where a larger color saturation value indicates a higher chromatic aberration level;

decreasing the gamma curve value if the chromatic aberration level of the frame of image is greater than or equal to a preset threshold;

maintaining an original gamma curve value if the chromatic aberration level of the frame of image is less than the preset threshold; and driving the display panel by using the adjusted gamma curve value.

Determining the chromatic aberration level of the frame of image is an important step of this method. A basis for the determining should be sufficient, and the obtained data should be accurate. First, a signal of the frame of image progressively scanned by the display panel is obtained. Then, a color saturation level of each pixel in the frame of image is calculated to form a color saturation value. The color saturation values of each row of pixels are collected and accumulated respectively to form line buffer data, and the line buffer data is stored in a line buffer, and then, the line buffer data of all rows is accumulated progressively to form frame buffer data. All the color saturation values in the frame buffer data are compared to obtain by calculation a maximum color saturation value to represent a color saturation level of the frame of image. When the color saturation level is calculated, the formula S=max(R,G,B)−min(R,G,B) is mainly employed. The color saturation level is selected according to a difference between a maximum value and a minimum value. A color saturation is closely related to a color tone of a pixel, and the color tone and the color saturation are both closely related to a chromatic aberration. A color saturation value of a whole frame can be calculated to represent a chromatic aberration condition of a whole frame of image to a specific extent. Therefore, a chromatic aberration is replaced with a color saturation that can be digitalized, so that a processor can find, according to different color saturations, a desired gamma curve value from a gamma adjustment lookup table for driving, thereby decreasing the chromatic aberration. Generally, an amount of storage of data is usually a data length of 8 bits. However, in fact, because the color saturation leads to omission of a plurality of pieces of process data, the data can be compressed to be stored at a data length less than or equal to 6 bits. In this way, the amount of storage is effectively decreased, thereby avoiding a problem that too much data of a line buffer is occupied, which affects processing of other data, and further affects picture display. A correspondence can be quickly determined by setting a lookup table, to quickly respond to adjustment of a gamma curve value. The adjusted gamma curve value is found from a gamma adjustment lookup table according to the color saturation value of the frame of image and the gamma curve value is controlled and adjusted. The gamma adjustment lookup table is formed in advance by setting a corresponding gamma adjustment value for each of different color saturations. When the S max approaches to 60, the chromatic aberration level is relatively high, so that a value by which the corresponding gamma curve value needs to be decreased is relatively large. When the S max approaches to 0 or 120, the chromatic aberration level is relatively low, the gamma curve value is rarely or even not adjusted.

Figure 6:
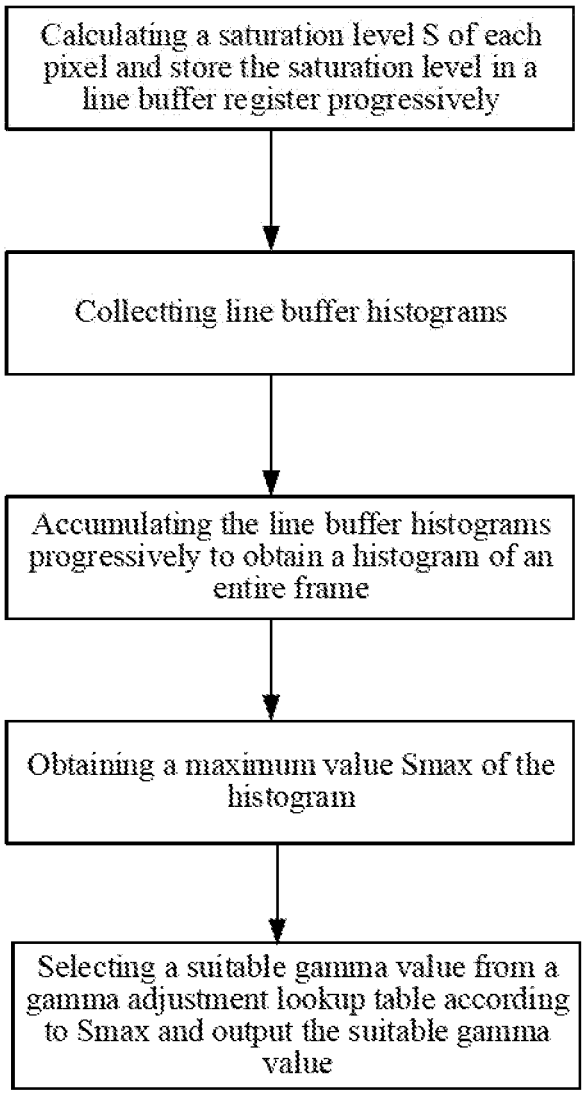
FIG. 6 is a schematic diagram of a method for dynamic gamma curve adjustment according to an embodiment of this application.

In one or more embodiments, referring to FIG. 6 and FIG. 7, a specific implementation is described in detail as follows:

An image signal, Red, Green, and Blue, progressively scanned by the display panel is obtained, the saturation level of each pixel, S=max(R,G,B)−min(R,G,B), is calculated, and they are stored in a line buffer respectively.

To decrease the amount of storage, the above pixel saturation S is recorded in 6 bits or less than 6 bits.

The foregoing line buffer histogram (line buffer histogram) is collected and accumulated.

To decrease an amount of storage of the line buffer, the foregoing histogram is divided by a multiple of 2 (for example, 8, 16, or 32, in this case, 32 is used), which is most cost-efficient. Using 1920×1080 as an example, a line buffer size=(1920/32)×6 bits.

The foregoing line buffer is accumulated progressively. Using 1080 lines as an example, a total of 1080 line buffers are accumulated.

A quantity of histogram buffers of a whole frame is counted to be 6 bits×(1920/32)×1080.

Quantities of all bits of every two of the foregoing histograms are compared, to obtain a maximum saturation of the histograms to represent a saturation level value S max of the whole image. A larger S max indicates a higher saturation of the image, and a smaller S max indicates a lower saturation of the image.

The foregoing S max is used as a reference for setting a gamma value of the panel (as shown in FIG. 7), and is recorded in a buffer of a timing control chip by using a gamma lookup table (LUT) to be selected by a gamma selector.

The algorithm of the foregoing process may dynamically adjust a characteristic of a panel according to a saturation of an image, to achieve a best characteristic of the panel.

Figure 8:
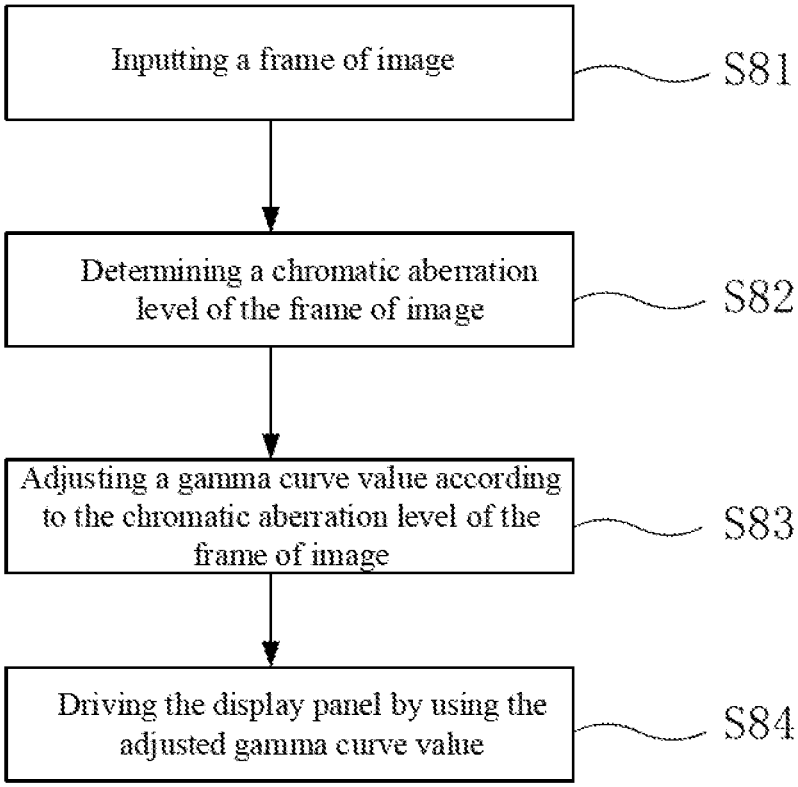
FIG. 8 is a schematic diagram of a method for driving a display panel according to an embodiment of this application.

In one or more embodiments, referring to FIG. 8, discloses a display panel, using the method for driving the display panel as described above.

It should be noted that the limitation of each step involved in the present solution is, not determined to limit the sequence of steps without affecting the implementation of the specific solution, and the step written in the foregoing may be prior. Execution may alternatively be carried out later, or even concurrently. As long as the scheme can be implemented, it should be considered as belonging to the scope of protection of this application.

The panel in this application may be a Twisted Nematic (TN) panel, an In-Plane Switching (IPS) panel, or a Vertical Alignment (VA) panel, and may certainly be any other suitable type of panel.

The foregoing contents are detailed descriptions of this application in conjunction with specific embodiments, and it should not be considered that the specific implementation of this application is limited to these descriptions. A person of ordinary skill in the art can further make simple deductions or replacements without departing from the concept of this application, and such deductions or replacements should all be considered as falling within the protection scope of this application.

What is claimed is:

1. A method for driving a display panel, the driving method comprising steps of:

inputting a frame of image;

determining a chromatic aberration level of the frame of image;

adjusting a gamma curve value according to the chromatic aberration level of the frame of image; and driving the display panel by using the adjusted gamma curve value;

wherein the step of adjusting a gamma curve value according to the chromatic aberration level of the frame of image comprises:

decreasing the gamma curve value if the chromatic aberration level of the frame of image is greater than or equal to a preset threshold;

wherein the step of decreasing the gamma curve value if the chromatic aberration level of the frame of image is greater than or equal to a preset threshold comprises:

decreasing the gamma curve value if the chromatic aberration level of the frame of image is greater than or equal to 0.02 when a viewing angle is 30 degrees;

wherein the step of determining a chromatic aberration level of the frame of image comprises:

obtaining a signal of the frame of image progressively scanned by the display panel;

calculating a color saturation level of each pixel in the frame of image to form a color saturation value;

collecting and accumulating the color saturation values of each row of pixels respectively to form line buffer data and storing the line buffer data in a line buffer;

accumulating the line buffer data of all rows progressively to form frame buffer data;

comparing all the color saturation values in the frame buffer data to obtain by calculation a maximum color saturation value to represent a color saturation level of the frame of image; and determining the chromatic aberration level of each frame of image by using the maximum saturation value of each frame of image, wherein a larger color saturation value indicates a higher chromatic aberration level.

2. The method for driving a display panel according to claim 1, wherein a higher chromatic aberration level indicates a larger value by which the gamma curve value is decreased.

3. The method for driving a display panel according to claim 1, wherein the step of adjusting a gamma curve value according to the chromatic aberration level of the frame of image comprises:

maintaining an original gamma curve value if the chromatic aberration level of the frame of image is less than the preset threshold.

4. The method for driving a display panel according to claim 1, wherein the step of decreasing the gamma curve value if the chromatic aberration level of the frame of image is greater than or equal to the preset threshold comprises:

maintaining an original gamma curve value if the chromatic aberration level of the frame of image is less than or equal to 0.02 when a viewing angle is 30 degrees.

5. The method for driving a display panel according to claim 1, wherein the maximum color saturation value falls within a first range or a second range;

when the maximum color saturation value falls within the first range, a larger color saturation value indicates a higher chromatic aberration level and a larger value by which the gamma curve value is decreased; and when the maximum color saturation value falls within the second range, a larger color saturation value indicates a lower chromatic aberration level, and a smaller value by which the gamma curve value is decreased.

6. The method for driving a display panel according to claim 5, wherein for the color saturation value, the first range is [0, 60) and the second range is [60, 120].

7. The method for driving a display panel according to claim 1, wherein the step of calculating a color saturation level of each pixel in the frame of image to form a color saturation value comprises:

selecting each row of pixels in the frame of image by using a multiple of 2 as an interval, and calculating a color saturation level of each of the selected pixels at intervals to form a color saturation value, wherein a formula of calculating the color saturation value is:

a formula $S=\max(R,G,B)-\min(R,G,B)$, wherein $S$ represents the color saturation value, $R$ represents a gray level of a red sub-pixel, $G$ represents a gray level of a green sub-pixel, and $B$ represents a gray level of a blue sub-pixel.

8. The method for driving a display panel according to claim 7, wherein a data size of each color saturation value is less than or equal to 6 bits.

9. The method for driving a display panel according to claim 7, wherein the step of adjusting a gamma curve value according to the chromatic aberration level of the frame of image comprises:

finding the adjusted gamma curve value from a gamma adjustment lookup table according to the color saturation value of the frame of image and controlling and adjusting the gamma curve value.

10. The method for driving a display panel according to claim 9, wherein the gamma adjustment lookup table is formed in advance by setting a corresponding gamma adjustment value for each of different color saturations; and when the color saturation value is 60, a difference between the adjusted gamma curve value and the original gamma curve value is the largest, and when the color saturation value is not equal to 60, a color saturation value farther away from 60 indicates a smaller difference between the gamma curve value and the original gamma curve value.

11. The method for driving a display panel according to claim 10, wherein when the color saturation is between 0 and 120, the gamma adjustment value satisfies that a gamma value is equal to 2.2.

12. A method for driving a display panel, the method comprising steps of:

inputting a frame of image;

obtaining a signal of the frame of image progressively scanned by the display panel;

selecting each row of pixels in the frame of image by using a multiple of 2 as an interval, and calculating a color saturation level of each of the selected pixels at intervals to form a color saturation value, wherein a formula of calculating the color saturation value is:

a formula $S=\max(R,G,B)-\min(R,G,B)$, wherein $S$ represents the color saturation value;

collecting and accumulating the color saturation values of each row of pixels respectively to form line buffer data and storing the line buffer data in a line buffer;

accumulating the line buffer data of all rows progressively to form frame buffer data, wherein a data size of each color saturation value is less than or equal to 6 bits;

comparing all the color saturation values in the frame buffer data to obtain by calculation a maximum color saturation value to represent the color saturation level of the frame of image;

determining the chromatic aberration level of each frame of image by using the maximum saturation value of each frame of image, wherein a larger color saturation value indicates a higher chromatic aberration level;

decreasing the gamma curve value if the chromatic aberration level of the frame of image is greater than or equal to a preset threshold;

maintaining an original gamma curve value if the chromatic aberration level of the frame of image is less than the preset threshold; and driving the display panel by using the adjusted gamma curve value.

* * * * *